United States Patent [19]

Denov et al.

[11] 4,023,462

[45] May 17, 1977

[54] MUSICAL INSTRUMENT TUNING DEVICE

[75] Inventors: Sam Denov, Chicago; Rame W. Bull, Mount Prospect; Walter Scott Bartky, Northfield, all of Ill.

[73] Assignee: Sam Denov, Chicago, Ill.

[22] Filed: Dec. 22, 1975

[21] Appl. No.: 643,252

[52] U.S. Cl. ..... 84/454; 84/419; 84/455

[51] Int. Cl.[2] ..... G10G 7/02

[58] Field of Search ..... 84/454, 419, DIG. 18, 84/455; 324/79 D

[56] References Cited

UNITED STATES PATENTS

| | | | |
|---|---|---|---|
| 2,818,759 | 1/1958 | Peterson | 84/454 |
| 3,144,802 | 8/1964 | Faber, Jr. et al. | 84/454 |
| 3,230,614 | 1/1966 | Rasch | 84/454 |
| 3,747,463 | 7/1973 | Hinger | 84/419 |
| 3,952,625 | 4/1976 | Peterson | 84/454 |

*Primary Examiner*—Stephen J. Tomsky

*Attorney, Agent, or Firm*—Anthony S. Zummer

[57] ABSTRACT

A musical instrument tuning device for tuning a musical instrument, having a vibrating sound producing member, is herein disclosed. The musical instrument tuning device includes a tone sensor, connected to the vibrating sound producing member. A comparator is connected to the tone sensor. A signal generator is also connected to the tone sensor. A tone adjustor is connected to the comparator, and to the vibrating sound producing member. The tone sensor senses the rate of vibration of the vibrating sound producing element, and produces a tone sensor signal indicative of the rate of vibration. The signal generator produces a selected frequency signal. The comparator receives the tone sensor signal and selected frequency signal, and produces an error signal indicative of the difference between the tone sensor signal and selected frequency signal. The tone adjustor receives the error signal, and adjusts the rate of vibration of the vibrating sound producing element in response thereto.

8 Claims, 8 Drawing Figures

CLOCK
22
COUNTER
20
LATCH
248
PULSE DELAY
160
PULSE GENERATOR
126
414
428
430
LEVEL DETECTOR
LEVEL DETECTOR
AMP.
74
76
DETECTOR
AMPLIFIER
COMPRESSION
CONTROLLED ATTEN.
72
18
LO PASS FILTER
54
VIBRATION SENSOR
16
3
2
10
28
8
765
4
746
758
728
738
COMPARATOR
24
COMPARATOR & D/A CONVERTER
602
6
26
ENCODING MATRIX

MUSICAL INSTRUMENT TUNING DEVICE

BACKGROUND OF THE INVENTION

Musical instruments, and in particular percussion and string instruments, require tuning in order to be played properly. Prior art methods of tuning musical instruments require some sort of human intervention. Classically, the piano tuner employs a tuning fork and his own hearing to tune a piano. Likewise, one must rely upon his personal impression of a tone when tuning a string instrument, such as a violin. Tuning gauges for percussion instruments, such as kettledrums, have been developed. These tuning gauges, however, only give an indication of the position of the adjustable tuning member, and not the frequency of the tone produced by the vibrating element or member of the musical instrument.

Not only must percussion and string instruments be tuned before a performance, but sometimes must be returned during the performance. A kettledrum must be tuned during the course of a performance. Typically, kettledrums are arranged in groups of four. Each kettledrum has a different tone range, which overlaps the tone range of its neighbor. Usually, the complete tone range for all four kettledurms is about 1.5 octaves.

Key changes for string instruments, which are made while playing, usually involve changing the effective length of the string by holding it immobile at selected positions. Tuning of a string instrument involves changing the restoring force of the vibrating member. Thus, key changing for stringed instruments is comparatively easy since, effectively, one is changing the boundary value conditions for a one-dimensional harmonic oscillator. Key changes on a kettledrum, however, can only be performed by varying the tension on the drumhead. Thus, a key change operation performed on a kettledrum is identical to a tuning operation on the drum for that key. Key changes for a kettledrum result from changing the coefficient of restoring force of the drumhead. Practically speaking, it is very difficult to change quickly and easily the boundary conditions for a two-dimensional harmonic oscillator, as embodied in a circular drumhead.

During the course of a performance, a kettledrum is played in a number of different keys. Thus, the musician must be able to adjust quickly and easily the tension, and thereby the restoring force, on four drumheads while the performance is being given.

Furthermore, as temperature, humidity and other external conditions change during the performance, the tension on the vibrating element of the musical instrument, whether the instrument is of the string or percussion variety, changes. Thus, the instrument has a tendency to lose its tune during the performance.

The tuning adjustment must also be performed in a darkened, and often noisy, orchestra pit. Nevertheless, it is necessary that the musical instrument be in tune and played in the proper key.

What is needed is a device which can tune a string or percussion instrument to a selected frequency automatically, quickly and accurately. The tuning device must be easy for a musician or non-technical person to operate. The tuning device must also be non-responsive to extraneous sound.

SUMMARY OF THE INVENTION

The present invention provides a musical instrument tuning system having a vibration sensor which optically senses movements of a vibrating sound producing member of a musical instrument. In the present embodiment, the musical instrument tuner is adapted to be used with a drum having a drumhead as the vibrating sound producing member. The vibration sensor produces a signal in response to the movement sensed. A compression amplifier is connected to the vibration sensor, and receives the signal from the vibration sensor. The compression amplifier maintains the amplitude of the signal at a constant level. A digital counter is connected to the compression amplifier to receive the constant amplitude signal. The digital counter starts and stops in response to the period of each signal cycle. A clock is also connected to the digital counter. The clock provides a plurality of regular pulses, which are counted by the digital counter while the digital counter is enabled in response to the constant amplitude signal. A comparator is connected to the digital counter. The comparator receives the count of the number of clock pulses which occur during each signal cycle. An input encoder is also connected to the comparator. The input encoder provides a digital encoder signal to the comparator in response to a selected key for a period of the drumhead fundamental frequency. The comparator generates a difference signal, which is indicative of the difference between the count provided by the digital counter and the digital encoder signal. The difference signal is representative of the difference between the period of the desired drumhead frequency and the period of the actual drumhead frequency. An electric motor is connected to the comparator. The electric motor is also connected, via a mechanical linkage of conventional tension lines, to the drumhead. The electric motor, via the mechanical linkage, adjusts the tension of the drumhead in response to the difference signal received from the comparator. When the drumhead has been adjusted to the desired drumhead fundamental frequency, no further signal will be received from the comparator; and the electric motor will cease adjusting the tension of the drumhead and lock in place.

It is a principal object of the present invention to provide a musical instrument tuning device, which automatically adjusts the frequency of a vibrating sound producing member while the musical instrument is being played.

It is a further object of the present invention to provide a musical instrument tuning device which is unresponsive to high-level extraneous sounds.

It is another object of the instant invention to provide a musical instrument tuning device which may be easily controlled by a musician or a non-technical operator.

It is a still further object of the present invention to provide a musical instrument tuning device which allows manual control of the timpani tuning.

Other objects and uses of this invention will become readily apparent to those skilled in the art upon a persual of the following specification in light of the accompanying drawings.

DESCRIPTION OF THE PREFERRED EMBODIMENT

Figure 1:
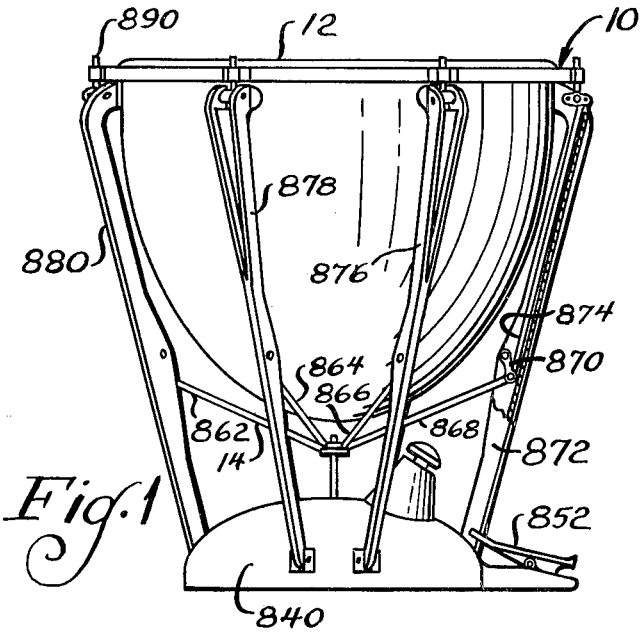
FIG. 1 is a side view of a conventional kettledrum.

The specific embodiment of the present invention disclosed herein is directed to a musical instrument tuning device for a kettledrum. Referring now to the drawings, and especially to FIGS. 5, 6, 7 and 8, a musical instrument tuning device 2 is generally disclosed therein. Musical instrument tuning device 2 includes a tone sensor 3. A comparator 4 is connected to tone sensor 3. A signal generator 6 is connected to comparator 4. A tone adjustor 8 is also connected to comparator 4. Musical instrument tuning device 2 is adapted to be used with a variety of percussion and string instruments. Musical instrument tuning device 2 is employed for tuning a drum 10, having a vibrating sound producing member or drumhead 12. Drumhead 12 is fitted to a top of a kettle 13. A conventional mechanical linkage 14 is connected to drumhead 12 to control the tension of the drumhead, and thus its rate of vibration. Tone sensor 3 is connected to vibrating sound producing member 12. Tone adjustor 8 is connected to vibrating sound producing member 12 through mechanical linkage 14.

When vibrating sound producing member 12 is placed in vibrational motion, tone sensor 3 senses the rate of vibration of the vibrating sound producing member and produces a tone sensor signal indicative of the rate of vibration. Signal generator 6 produces a selected frequency signal, which is indicative of the frequency or key to which drum 10 is to be tuned. Comparator 4 receives both the tone sensor signal and the selected frequency signal, and produces an error signal indicative of the the difference between the tone sensor signal and the selected frequency signal. Tone adjustor 8 receives the error signal, and adjusts the rate of vibration of vibrating sound producing member 12 in response thereto.

A vibration sensor, generally indicated by numeral 16, is located inside kettle 13 under drumhead 12. Vibration sensor 16 is connected electrically to a compression amplifier 18, as may be seen in FIGS. 5 and 8. A digital counter 20 is connected to compression amplifier 18 to receive signals from compression amplifier 18. A clock 22 is also connected to counter 20. Clock 22 and digital counter 20 act as frequency-determining means. Tone sensor 3 includes vibration sensor 16, compression amplifier 18, digital counter 20 and clock 22.

A plurality of comparators 24 is connected to counter 20. Comparator 4 includes the plurality of comparators 24. An input encoder 26 is also connected to comparator 24. Signal generator 6 includes input encoder 26. An electric motor 28, which acts as electromechanical means, is connected to the plurality of comparators 24 to receive an electrical output of the plurality of comparators 24. Tone adjustor 8 includes electric motor 28.

Vibration sensor 16 is an optical vibration sensor, and has a pair of photoresistors 30 and 32, respectively. Photoresistors 30 and 32 are separated by an insulator strip 34. A light source 36 is positioned within kettle 13 beneath drumhead 12. Light source 36 directs a beam of light 37, through a focussing lens 39, against a reflective patch 38, which is reflected onto photoresistors 30 and 32. Reflective patch 38 is affixed to the inside of drumhead 12. Photoresistors 30 and 32 form two arms of a conventional bridge circuit 40. The other two arms of the bridge circuit are formed by a resistor 42 and a resistor 44. Bridge circuit 40 is connected at a pair of points 46 and 48 to a voltage source. A contact point 50, located between photoresistive elements 30 and 32, is connected to ground. A contact point 52, located between resistors 42 and 44, is connected to a lowpass filter 54.

Low-pass filter 54 has a plurality of ganged RC circuits. A resistor 56 is connected to contact point 52. A capacitor 58 is connected between resistor 56 and ground. A resistor 60 is connected to the junction of resistor 56 and capacitor 58. A capacitor 62 connects resistor 60 to ground. A resistor 64 is connected to the junction of resistor 60 and capacitor 62. A capacitor 66 connects resistor 64 to ground. A resistor 68 is connected to the junction of resistor 64 and capacitor 66. A capacitor 70 connects resistor 68 to ground.

Compression amplifier 18 is connected to the junction of resistor 68 and capacitor 70 of low-pass filter 54. Compression amplifier 18 includes a controlled attenuator 72. Controlled attenuator 72 is connected to low-pass filter 54. An amplifier 74 is connected to controlled attenuator 72. A detector 76 is connected in a feedback loop from amplifier 74 to controlled attenuator 72.

A resistor 78 is connected to the junction of capacitor 70 and resistor 68. An operational amplifier 80 is connected to resistor 78 at its non-inverting terminal. A variable resistance 82 is connected from the output terminal of operational amplifier 80 to the inverting terminal of operational amplifier 80. A resistor 84 is connected between variable resistor 82 and ground. Operational amplifier 80, variable resistor 82, and resistor 84, comprise amplifier 74.

A capacitor 86 is connected to the output of operational amplifier 80. A resistor 88 is connected between capacitor 86 and ground. A lead 89 is connected to resistor 88. A resistor 90 is connected at the junction of capacitor 86 and resistor 88. A diode 92 is connected in series with resistor 90. A resistor 94 is connected to diode 92, opposite resistor 90 and parallel to resistor 88. A capacitor 96 is connected parallel to resistor 94. A resistor 98 is connected in series with diode 92 at capacitor 96. An NPN transistor 100, having a base 102, an emitter 104 and a collector 106, is connected at base 102 to resistor 98. Emitter 104 is connected to lead 89. Collector 106 is connected to a lead 107. A resistor 108 is connected to lead 89, adjacent emitter 104 of transistor 100. A potentiometer 110 is connected in series to resistor 108. A resistor 112 is connected in series to potentiometer 110. Resistor 112 is connected at point 114 to a positive voltage source, having a 15-volt potential. Lead 107 is connected, via a movable potentiometer tap 116, to potentiometer 110.

Capacitor 86, resistor 88, resistor 90, diode 92, resistor 94, capacitor 96, resistor 98, transistor 100, resistors 108 and 112, and potentiometer 110, all comprise detector 76.

Lead 107 is connected to an FET (Field Effect Transistor ) 118. FET 118 has a gate 120, a drain terminal 122, and a source terminal 124. Gate 120 is connected to lead 107. Source terminal 124 is connected to ground. Drain terminal 122 is connected to the non-inverting terminal of operational amplifier 80. FET 118 is the controlled attenuator 72.

A pulse generator 126 is connected to the output of operational amplifier 80. Included within pulse generator is a square wave generator 128. Square wave generator 128 inludes a capacitor 130. Capacitor 130 is connected to the output of operational amplifier 80. A resistor 132 is connected in series with capacitor 130. Resistor 132 is connected to an inverting terminal of an operational amplifier 134. A feedback resistor 136 is connected between the output terminal of operational amplifier 134 and the inverting terminal of operational amplifier 134. A resistor 138 connects a non-inverting terminal of operational amplifier 134 to ground. Operational amplifier 134 is connected at its output connection to a divide circuit 140. Divide circuit 140 is also part of pulse generator 126.

A resistor 142 is connected to divide circuit 140. A capacitor 144 is connected between resistor 142 and ground.

An exclusive OR gate 146, having a pair of input terminals 148 and 150, is connected at terminal 148 to the junction of resistor 142 and capacitor 144. A lead 152 is connected between clock 140 and resistor 142. A lead 154 is connected between lead 52 and terminal 150. Exclusive OR gate 146 has an output terminal 156, to which is connected a lead 158.

A pulse delay circuit 160 is connected to pulse generator 126. Pulse delay circuit 160 includes a resistor 162, connected to lead 152. A capacitor 164 is connected between resistor 162 and ground. A resistor 166 is connected to lead 152, in parallel with resistor 162. A capacitor 168 connects resistor 166 to ground. An exclusive OR gate 170, having a pair of input terminals 172 and 174, and an output terminal 176, is connected at input terminal 172 to the junction of resistor 162 and capacitor 164. Likewise, exclusive OR gate 170 is connected at input terminal 174 to the junction of resistor 166 and capacitor 168.

Resistors 162 and 166, capacitors 164 and 168, and exclusive OR gate 170, form pulse delay circuit 160. A lead 178 is connected to output terminal 176 of exclusive OR gate 170.

A twelve-bit binary counter 20, having a clock terminal 180, a reset terminal 182, and a plurality of output terminals 186, 188, 190, 192, 194, 196, 198, 200, 202, 204 and 206, is connected at reset terminal 182 to output terminal 176 of exclusive OR gate 170.

A lead 208 is connected to lead 158. A resistor 210 is connected in series with lead 208. A capacitor 212 connects resistor 210 to ground. A NOR gate 214, having a pair of input terminals 216 and 218, and an output terminal 220, is connected to resistor 210 at input terminal 216. NOR gate 214 is connected at its output terminal 220 to clock terminal 180 of twelve-bit binary counter 20. Lead 178 is connected to reset terminal 182 of digital counter 20.

Clock 22 is connected to input terminal 218 of NOR gate 214. Clock 22 includes a NOR gate 222, having input terminals 224 and 226, and an output terminal 228. Input terminal 226 of NOR gate 222 is connected to ground. Output terminal 228 and input terminal 224 have a resistor 230 connected thereacross. A resistor 232 is connected to resistor 230. A quartz crystal 234 is connected between resistors 230 and 232. A capacitor 236 connects the junction of quartz crystal 234 and resistor 230 to ground. A capacitor 238 connects the junction of quartz crystal 234 and resistor 232 to ground. A NOR gate 240, having a pair of input terminals 242 and 244, and an output terminal 246, is connected at its input terminal 242 to output terminal 228 of NOR gate 222. Input terminal 244 of NOR gate 240 is connected to ground. Output terminal 246 is connected to input terminal 218 of NOR gate 214.

A latch 248 is connected to counter 20 and pulse generator 246. Latch 248 includes a plurality of separate latches 250, 252 and 254. Latch 250 has a plurality of input terminals 256, 258, 260 and 262, which are respectively connected to output terminals 184, 186, 188 and 190 of digital counter 20. Latch 250 also has an enable terminal 264. By the same token, latch 252 has a plurality of input terminals 266, 268, 270 and 272, which are respectively connected to output terminals 192, 194, 196 and 198 of binary counter 20. Latch 252 also has an enable terminal 274. Latch 254 has a plurality of input terminals 276, 278, 280 and 282, which are respectively connected to output terminals 200, 202, 204 and 206 of twelve-bit binary counter 20. Latch 254 has an enable terminal 284. Lead 158 is connected in parallel to enable terminals 264, 274 and 284 of latches 250, 252 and 254, respectively.

Latch 250 has a plurality of output terminals 286, 288, 290 and 292, respectively. Latch 252 has a plurality of output terminals 294, 296, 298 and 300, respectively. Latch 254 has a plurality of output terminals 302, 304, 306 and 308, respectively.

A plurality of comparators 24 is connected to latch 248; and is made up of comparators 310, 312 and 314, which are respectively connected to latches 250, 252 and 254. Comparator 310 has a plurality of latch input terminals 316, 318, 320 and 322, which are respectively connected to output terminals 286, 288, 290 and 292 of latch 250. Comparator 310 has a plurality of encoder input terminals 324, 326, 328 and 330. Comparator 310 has a plurality of input side terminals 332, 334 and 336. Terminals 332 and 336 are connected to ground. Terminal 334 is connected to a resistor 338. Resistor 338 is connected to a voltage source. Comparator 310 has a plurality of output side terminals 340, 342 and 344.

Comparator 312 has a plurality of latch input terminals 346, 348, 350 and 352, which are respectively connected to latch output terminals 294, 296, 298 and 300. Comparator 312 has a plurality of encoder input terminals 354, 356, 358 and 360. Comparator 312 has a plurality of input side terminals 362, 364 and 366. Terminals 362 and 366 are connected to ground. Terminal 364 is connected to a resistor 368. Resistor 368 is connected to a potential source. Comparator 312 has a plurality of output side terminals 370, 372 and 374.

Comparator 314 has a plurality of latch input terminals 376, 378, 380 and 382, which are respectively connected to output terminals 302, 304, 306 and 308 of latch 254. Comparator 314 has a plurality of encoder input terminals 384, 386, 388 and 390. Comparator 314 also has a plurality of input side terminals 392, 394 and 396, which are respectively connected to output side terminals 370, 372 and 374 of comparator 312. Comparator 314 also has a plurality of output side terminals 398, 400 and 402.

A NAND gate 404, having a plurality of input terminals 406, 408 and 410, and an output terminal 411, is connected at input terminal 406 to output terminal 344 of comparator 310. Input terminal 408 is connected to output terminal 400 of comparator 314. Input terminal 410 of NAND gate 404 is connected to lead 411. Lead 411 is connected to an AND gate 414 at an output terminal 416. AND gate 414 has a pair of input terminals 418 and 420. A switch 422 is connected to lead 418. A capacitor 424 is connected to lead 418, and in parallel with switch 422. Capacitor 424 is also grounded. A resistor 426 is connected to capacitor 424 in series with input terminal 418 of AND gate 414. A first level detector 428 is connected to resistor 426. A second level detector 430 is connected to input terminal 420 of AND gate 414.

An operational amplifier 432, having a non-inverting input terminal 434, an inverting input terminal 436 and an output terminal 438, is connected via output terminal 438 to resistor 426. Inverting terminal 436 is connected to lead 107. Non-inverting terminal 434 is connected to a potentiomenter 440 via a tap 441. Potentiometer 440 is connected to a resistor 442 and a resistor 444. Resistor 442 is connected to a fifteen-volt positive voltage source at a point 446. Resistor 444 is grounded; and is connected in parallel to a resistor 448. A potentiometer 450, having a movable tap 452, is connected to resistor 448. A resistor 454 is connected to potentiometer 450. Resistor 454 is connected at a point 456 to a fifteen-volt positive potential. Movable tap 452 is connected to an operational amplifier 458.

Operational amplifier 458 has an inverting terminal 460, a non-inverting terminal 462 and an output terminal 464. Inverting terminal 460 is connected to movable tap 452. Noninverting terminal 462 is connected to lead 107. Output terminal 464 is connected to input terminal 420 of AND gate 414.

Resistors 442 and 444, potentiometer 440, and operational amplifier 432, comprise first level detector 428. Resistors 448 and 454, potentiometer 450, and operational amplifier 458, comprise second level detector 430.

A transistor 466, having a base 468, an emitter 470 and a collector 472, is connected at base 468 to lead 412. Emitter 470 is connected to a light-emitting diode 474. Light-emitting diode 474 is, in turn, connected to a resistor 476. Resistor 476 is connected at a point 478 to a positive potential. Collector 472 is connected to ground.

A NAND gate 480, having a plurality of input terminals 482, 484 and 486, and an output terminal 488, is connected at input terminal 482 to output side terminal 340 of comparator 310; is connected at input terminal 484 to output terminal 400 of comparator 314; and is connected at input terminal 486 to lead 411. A NAND gate 490, having a pair of input terminals 492 and 494, and an output terminal 496, is connected at input terminal 492 to output terminal 402 of comparator 314; is connected at input terminal 402 of comparator 314; and is connected at input terminal 494 to lead 412. A NAND gate 498, having a pair of input terminals 500 and 502, and an output terminal 504, is connected at input terminal 500 to output terminal 398 of comparator 314. NAND gate 498 is connected at its input terminal 502 to lead 411.

Figures 5, 7:
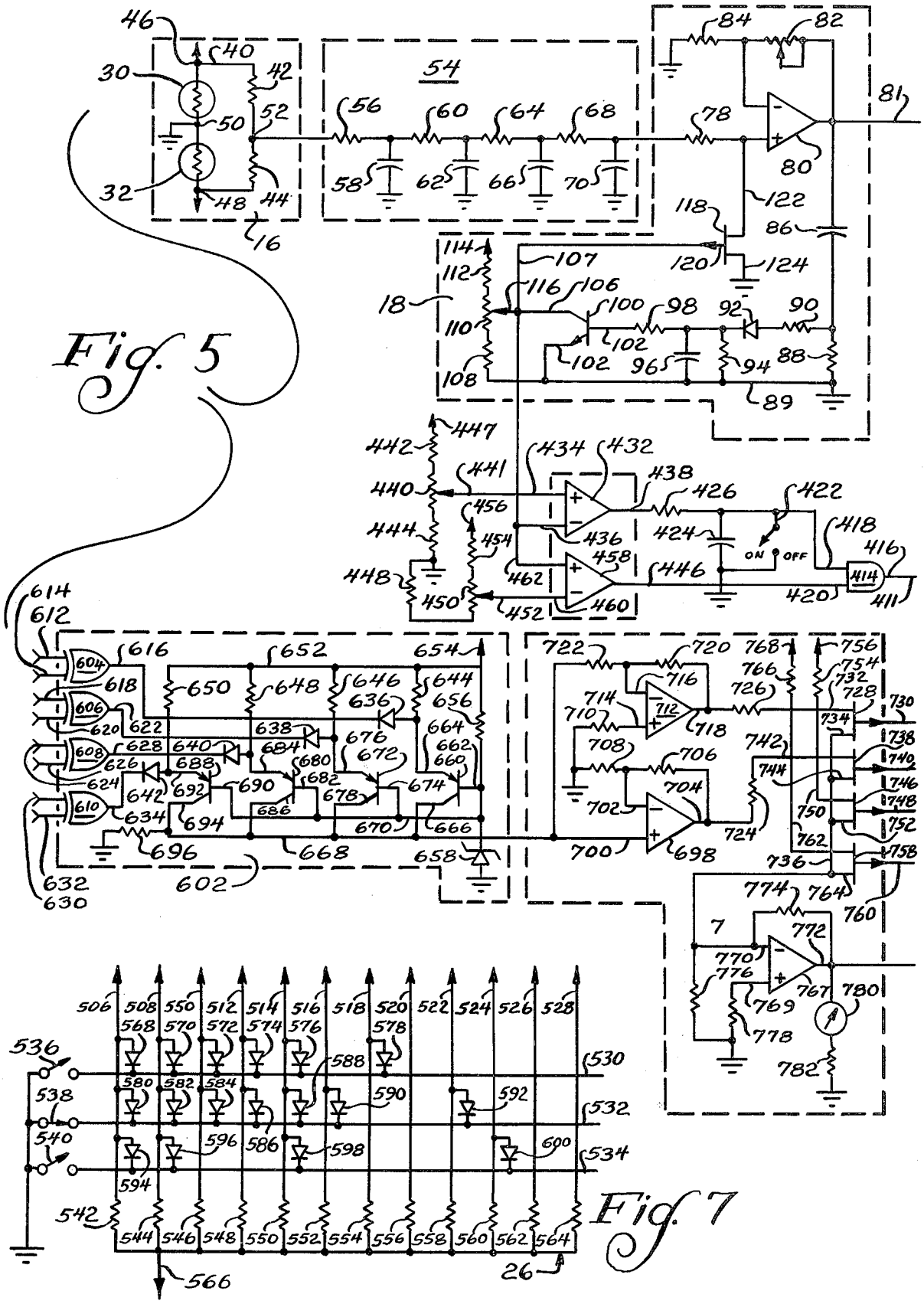
FIG. 5 is a schematic diagram of a portion of the circuitry of the musical instrument tuning device.
FIG. 7 is a schematic diagram of the binary encoding matrix of the circuit of FIG. 5.
Figure 6:
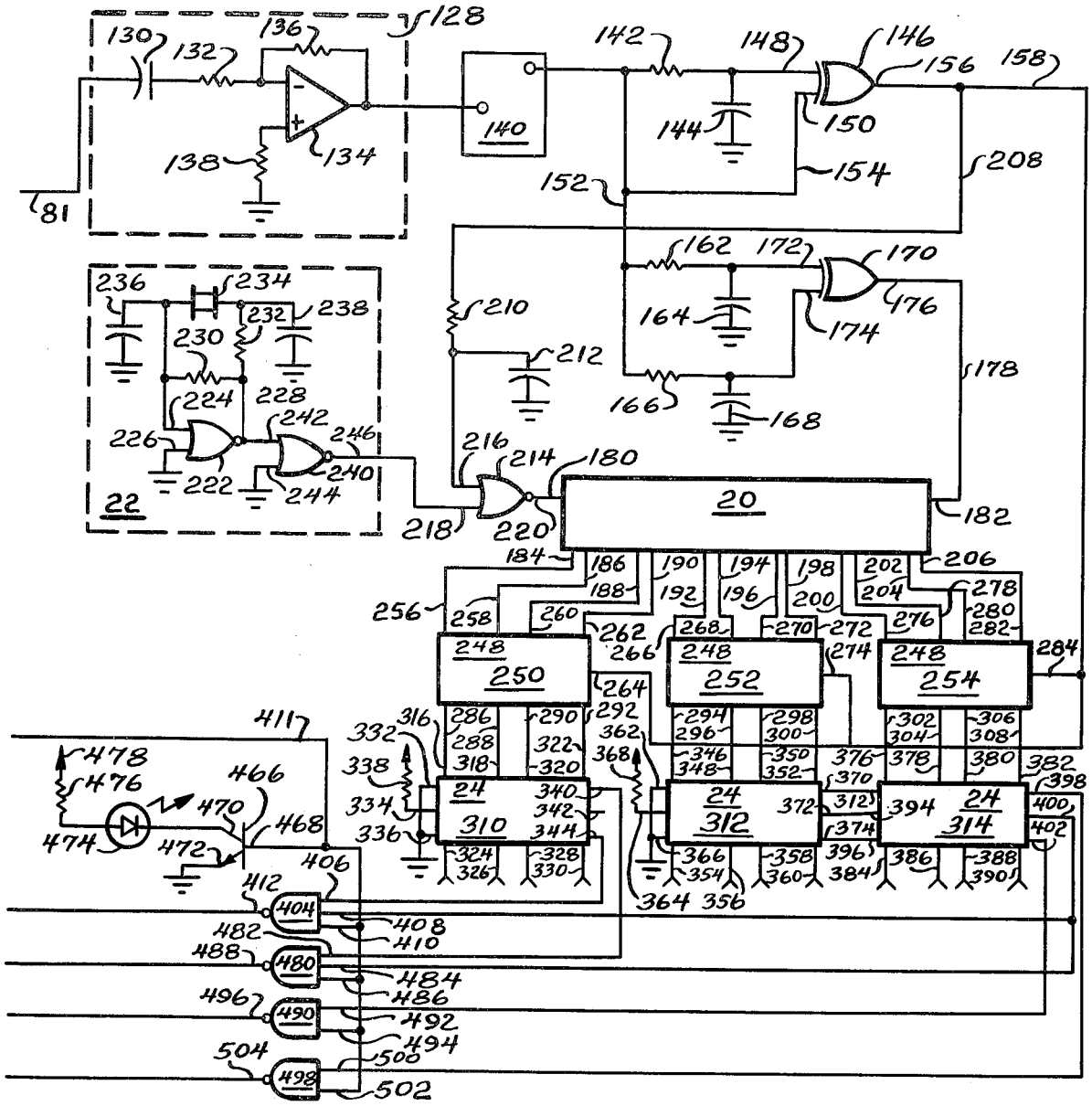
FIG. 6 is a schematic diagram of another portion of the circuitry of the musical instrument tuning device of FIG. 5.
Figure 6:
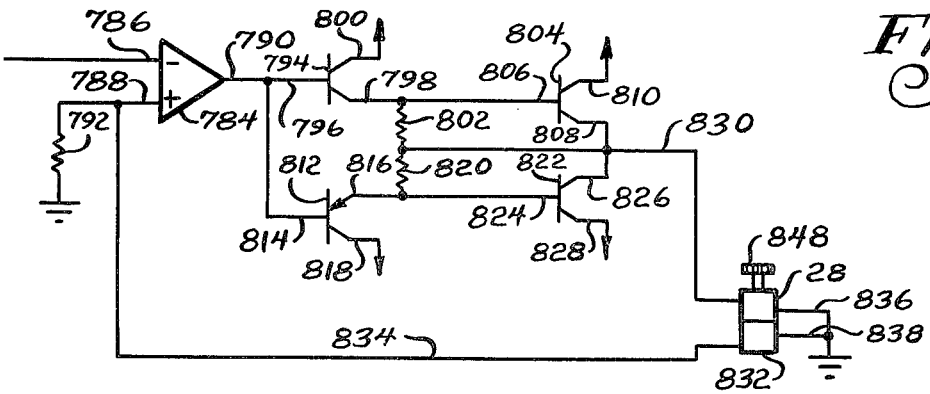
Figure 8:
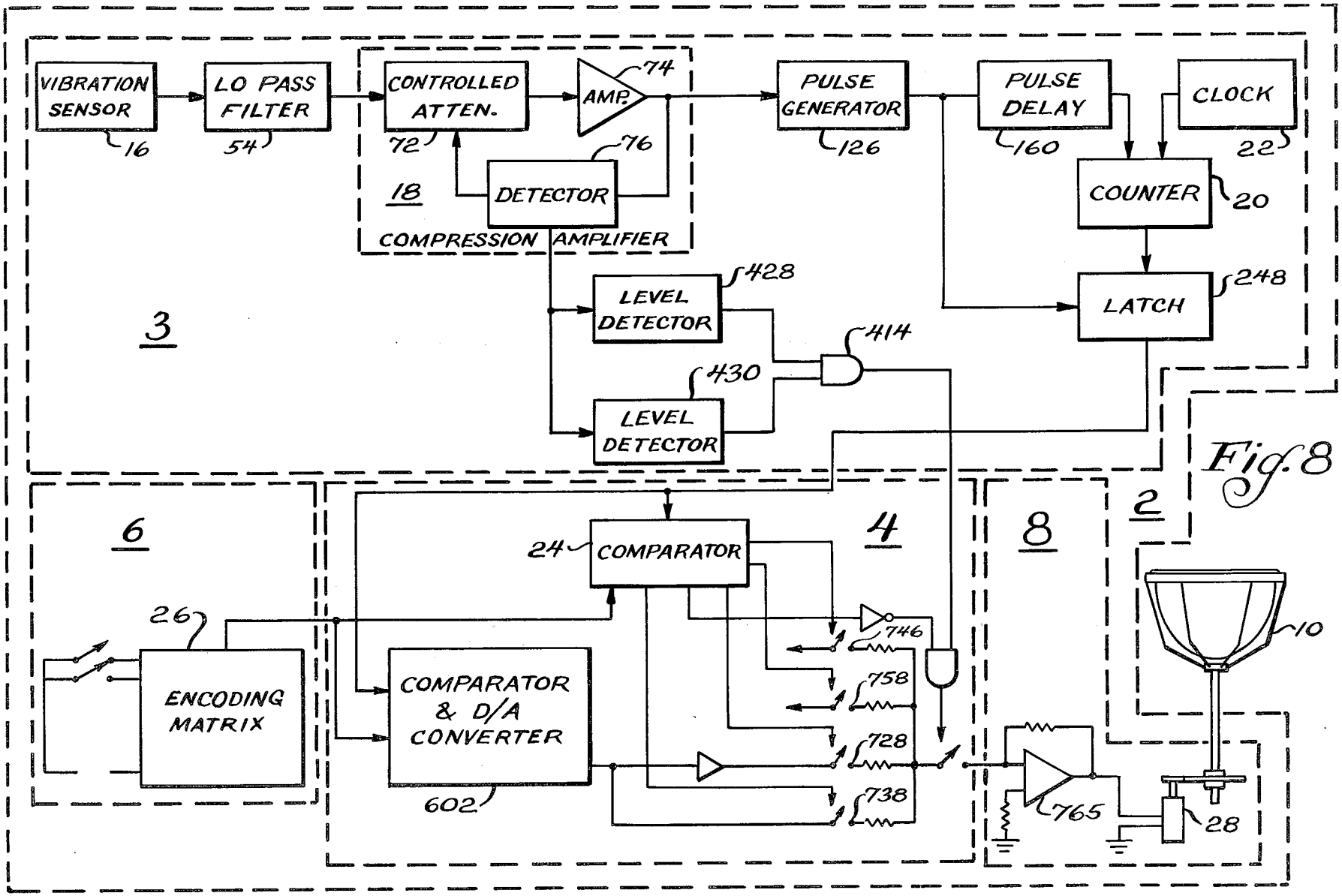
FIG. 8 is a block diagram of the musical instrument tuning device.

Referring now to FIG. 7, input encoder 26 is shown therein. Input encoder 26 is a binary encoding matrix. Binary encoding matrix 26 has a plurality of columns 506, 508, 510, 512, 514, 516, 518, 520, 522, 524, 526 and 528. In this embodiment, encoding matrix 26 has plurality of rows 530, 532 and 534. Rows 530, 532 and 534 each have a respective switch 536, 538 and 540 which is selectively connectable to ground. Each of columns 506, 508, 510, 512, 514, 516, 518, 520, 522, 524, 526 and 528 has a respective identical resistance 542, 544, 546, 548, 550, 552, 554, 556, 558, 560, 562 and 564 in series with it. Resistances 542 through 564 are connected in parallel to a potential source connection point 566, which is connected to a positive potential. Row 530 has a plurality of shorting diodes 568, 570, 572, 574, 576 and 578 connected to columns 506, 508, 510, 512, 514 and 518, respectively. Row 532 has a plurality of shorting diodes 580, 582, 584, 586, 588, 590 and 592 connected respectively to columns 506, 508, 510, 512, 514, 516 and 522. Row 534 has a plurality of shorting diodes 594, 596, 598 and 600 connected respectively to columns 506, 508, 514 and 524.

Columns 506, 508, 510 and 512 are respectively connected to input encoder terminals 324, 326, 328 and 330 of comparator 310. Columns 514, 516, 518 and 520 are respectively connected to input encoder terminals 354, 356, 358 and 360 of comparator 312. Columns 522, 524, 526 and 528 are respectively connected to input encoder termnals 384, 386, 388 and 390 of comparator 314.

A four-bit comparator and digital-to-analog converter 602 is connected to latch 248 and input encoder 26. Comparator and digital-to-analog converter 602 includes a plurality of exclusive OR gates 604, 606, 608 and 610.

Exclusive OR gate has a pair of input terminals 612 and 614, and an output terminal 616. Exclusive OR gate 606 has a pair of input terminals 618 and 620, and an output terminal 622. Exclusive OR gate 608 has a pair of input terminals 624 and 626, and an output terminal 628. Exclusive OR gate 610 has a pair of input terminals 630 and 632, and an output terminal 634. Input terminals 612, 618, 624 and 630 are respectively connected to output terminals 286, 288, 290 and 292 of latch 250. Input terminals 614, 620, 626 and 632 are respectively connected to columns 506, 508, 510 and 512 of encoding matrix 26. Output terminals 616, 622, 628 and 634 are respectively connected to a plurality of diodes 636, 638, 640 and 642.

A resistor 644 is connected to diode 636. A resistor 646 is connected to diode 638. A resistor 648 is connected to doide 640. A resistor 650 is connected to diode 642. Resistors 644, 646, 648 and 650 are connected in parallel to a lead 652. Lead 652 is connected to a voltage point 654. A positive voltage is applied at point 654. A resistor 656 is connected to lead 652 at point 654. A back-biased Zener diode 658 is connected to resistor 656. Back-biased Zener diode 658 is grounded.

A PNP transistor 660, having a base 662, an emitter 664 and a collector 666, is connected at its base 662 to resistor 656. Emitter 664 is connected to the junction of resistors 644 and diode 636. Collector 666 is connected to a lead 668. A lead 670 is also connected to resistor 656. A PNP transistor 672, having a base 674, an emitter 676 and a collector 678, is connected by its base 674 to lead 670. Emitter 676 is connected to the junction of resistor 646 and diode 638. Collector 678 is connected to lead 668. A transistor 680, having a base 682, an emitter 684 and a collector 686, has its base 682 connected to lead 670. Emitter 684 is connected to the junction of resistor 648 and diode 640. Collector 686 is connected to lead 668. A PNP transistor 688, having a base 690, an emitter 692 and a collector 694, is connected by its base 690 to lead 670. Emitter 692 is connected to the junction of resistor 650 and diode 642. Colllector 694 is connected to lead 668. A resistor 696 is connected to the junction of collector 694 and lead 668. Resistor 696 is also grounded.

An operational amplifier 698, having a non-inverting terminal 700, an inverting terminal 702 and an output terminal 704, is connected at its non-inverting terminal 700 to lead 668. A resistor 706 is connected between output terminal 704 and inverting terminal 702. A resistor 708 is connected to resistor 706 and inverting terminal 702. Resistor 708 is grounded. A resistor 710 is connected to resistor 708, in parallel with resistor 708. Resistor 710 is connected to an operational amplifier 712, having a non-inverting input terminal 714, an inverting input terminal 716 and an output terminal 718. Resistor 710 is connected to non-inverting terminal 714. A resistor 720 is connected between output terminal 718 and inverting input terminal 716. A resistor 722 is connected between the junction of resistor 720 and inverting terminal 716 and lead 668. A resistor 724 is connected to output terminal 704. A resistor 726 is connected to output terminal 718.

Resistor 726 is connected to a P-channel FET 728, having a gate 730, a source 732 and a drain 734. Resistor 726 is connected to source 732. Gate 730 is connected to output terminal 412 of NAND gate 404. Drain 734 is connected to a lead 736.

Resistor 724 is connected to a P-channel FET 738, having a gate 740, a source 742 and a drain 744. Resistor 724 is connected to source 742. Gate 740 is connected to output terminal 488 of NAND gate 480. Drain 744 is connected in parallel to drain 742 with lead 736. A P-channel FET 746 is connected to lead 736. FET 746 has a gate 748, a source 750 and a drain 752. Drain 752 is connected to lead 736. Source 750 is connected to a resistor 754. Resistor 754 is connected to a voltage source at a point 756. Gate 748 is connected to output terminal 466 of NAND gate 490.

A P-channel FET 758, having a gate 760, a source 762 and a drain 764, is connected to lead 736 at drain 764. Source762 is connected to a resistor 766. Resistor 766 is connected to a voltage source at a point 768. Gate 760 is connected to output terminal 504 of NAND gate 498. A motor control amplifier 765 is connected to lead 736. Motor control amplifier 765 includes an operational amplifier 767, having a non-inverting input terminal 769, an inverting input terminal 770 and an output terminal 772. Operational amplifier 767 is connected at its inverting terminal 770 to drain 764 of FET 758. A resistor 774 is connected between output terminal 772 and inverting terminal 770. A resistor 776 is connected to inverting terminal 770. A resistor 778 is connected between resistor 776 and non-inverting input terminal 769. Resistors 776 and 778 are also connected to ground. A meter 780 is connected to output terminal 772. A resistor 782 is connected to meter 780. Resistor 782 is grounded.

Motor control amplifier 765 further includes an operational amplifier 784, having an inverting terminal 786, a noninverting inverting input terminal 788 and an output terminal 790. Operational amplifier 784 is connected at its inverting terminal 786 to output terminal 772 of operational amplifer 769. A resistor 792 is connected to non-inverting terminal 788 of operational amplifier 784. Resistor 792 is grounded.

Motor control amplifier 765 also includes an NPN transistor 794, having a base 796, an emitter 798 and a collector 800. NPN transistor 794 is connected by its base 796 to output terminal 790 of operational amplifier 784. Emitter 798 of transistor 794 is connected to a resistor 802. Emitter 798 is also connected to an NPN transistor 804, having a base 806 and a collector 810. Base 806 of transistor 804 is connected to emitter 798 of transistor 794. Collector 800 of transistor 794 is connected to a positive voltage source. Collector 810 of transistor 804 is also connected to a positive voltage source. A PNP transistor 812, having a base 814, an emitter 816 and a collector 818, is connected by its base 814 to output terminal 790 of operational amplifier 784. A resistor 820 is connected between emitter 816 and resistor 802. A PNP transistor 822, having a base 824, an emitter 826 and a collector 828, is connected by its base 824 to the junction of emitter 816 and resistor 820. Emitter 826 of transistor 822 is connected to emitter 808 of transistor 804. Collector 818 is connected to a negative voltage source. Collector 828 is also connected to a negative voltage source. A lead 830 is connected to the junction of resistors 802 and 820. Lead 830 is also connected to the junction of emitters 808 and 826. Lead 830 is connected to motor 28. A tachometer 832 is connected to motor 830. A lead 834 is connected from tachometer 832 to non-inverting input terminal 788 of operational amplifier 784. A lead 836 is connected to motor 28. A lead 838 is connected to tachometer 832. Leads 836 and 838 are connected in parallel to ground.

Figure 2:
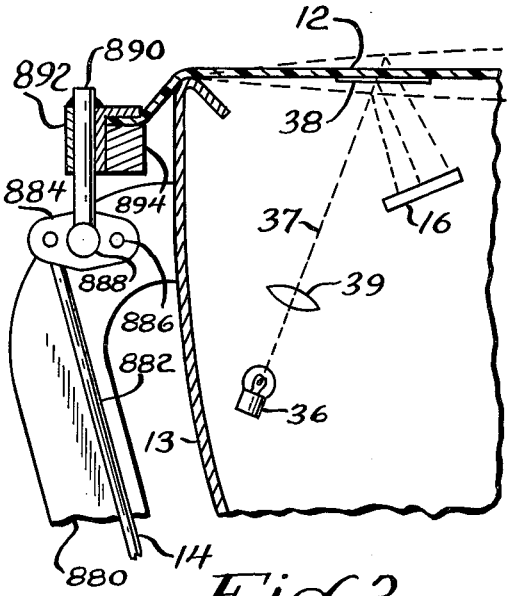
FIG. 2 is a cutaway fragmentary view of a portion of the drum of FIG. 1, showing details of the construction of the drumhead and a portion of its associated mechanical linkage, and showing details of the vibration sensor.
Figure 3:
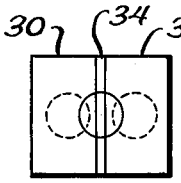
FIG. 3 is a plan view of a portion of the vibration sensor, showing details of the photoresistors of the vibration sensor of FIG. 2.
Figure 4:
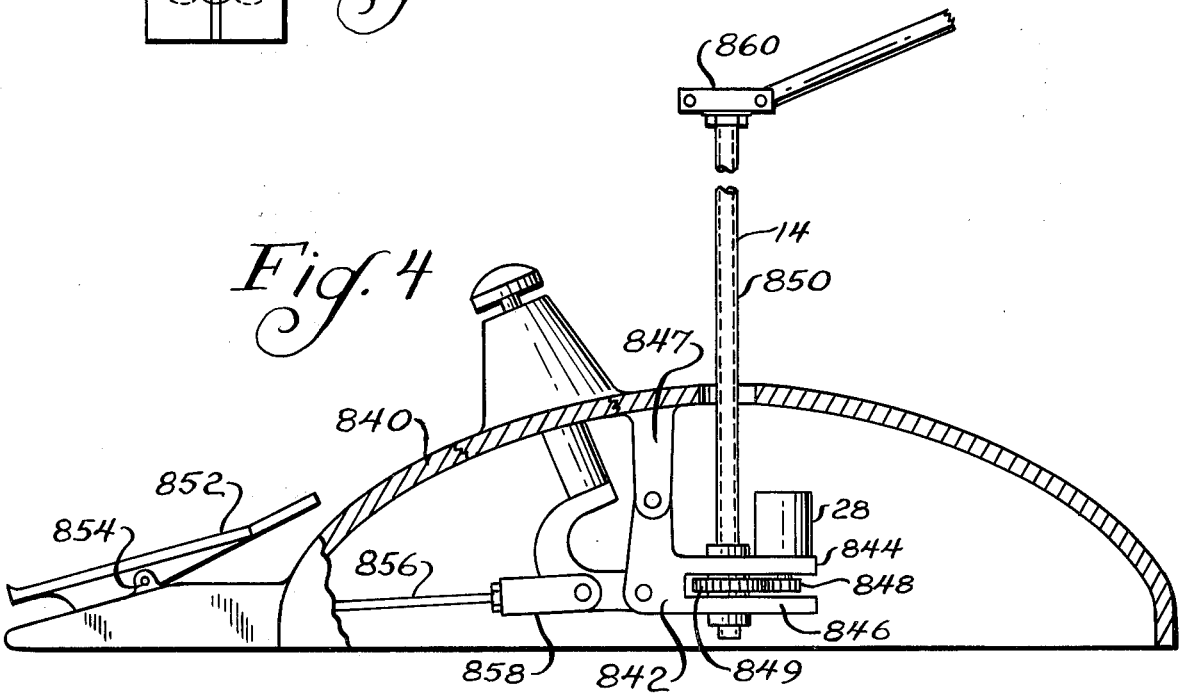
FIG. 4 is a side view of the base portion of the drum of FIG. 1, having portions broken away and showing details of a portion of the mechanical linkage which adjusts the drumhead tension.

Referring now to FIGS 1, 2 and 4, motor 28 can be seen in FIG. 4. Motor 28 is contained in a base 840 of drum 10. Motor 28 is carried on a shaft arm 842. Shaft arm 842 has a pair of spaced tongues 844 and 846, extending perpendicularly from the body of shaft arm 842. Shaft arm 842 is pivotedly connected to an arm support 847. Arm support 847 is fixedly connected to the inside of base 840. A gear 848 is rotatably mounted between tongues 844 and 846, and is connected drivingly to motor 28. A gear 849 meshingly engages gear 840. Gear 849 is rotatably mounted between spaced tongues 844 and 846. Gear 849 is threadedly connected to a threaded rod 850. Threaded rod 850 is, in turn, part of mechanical linkage 14. Base 840 has a foot pedal 852 pivotedly attached thereto. Foot pedal 852 is connected to a hinge 854. Hinge 854 is connected to base 840. A push rod 856 is connected to foot pedal 852; and, via a link 858, to shaft arm 842.

Mechanical linkage also includes a central pivot head 860, connected to the end of threaded rod 850, as is conventional in the construction of kettledrums. Pivot head 860 is connected, via a plurality of tension lines 862, 864, 866 and 868, to a plurality of hinges, one of which is shown as hinge 870. Hinge 870 is mounted in a leg 872 of kettledrum 10. Hinge 870 is linkingly connected to a push rod 874. Leg 872 and a plurality of legs 876, 878 and 880 are connected to base 840. In addition, legs 872, 876, 878 and 880 are supportively connected to kettle 13. Leg 880 has a tension line 882 mounted therein. Tension line 882 is hingledly connected to tension line 862. Tension line 882 is connected to a hinge 884, which has a pivot 886 and a pivot 888. Pivot 886 is connected to leg 880. Pivot 888 is connected to a support rod 890. A counter hoop 892 is connected to rod 890. Counter hoop 892 is of a circular configuration; and surrounds drumhead 12. A flesh hoop 894 is clamped under counter hoop 892. Drumhead 12 is fixedly attached to flesh hoop 894.

In operation, drum 10 is struck off-center on drumhead 12 to produce a desired tone. Drumhead 12 vibrates, as is shown in FIG. 2. The vibration produces both a fundamental tone and harmonics. At the time the drumhead is struck, and immediately thereafter, the drumhead generates a large percentage of harmonics and noise. The harmonics and noise decay more rapidly than the fundamental tone. Thus, the tone becomes more pure with time. The typical decay time for a tone generated by a twenty-six-inch kettledrum is on the order of two seconds. The vibration of drumhead 12 carries reflective patch 38 through a similar vibration. Light 36 projects light beam 37 against reflective patch 38. As reflective patch 38 moves, light beam 37 swings through a portion of an arc, across photoresistors 30 and 32.

Optical vibration sensor 16, as was set forth above, is comprised of two photoresistors 30 and 32, which are connected in a Wheatstone bridge circuit 40. Optical vibration sensor 16, of which Wheatstone bridge circuit 40 is a part, produces a signal in response to the vibrations of drumhead 12. The bridge signal is received by low-pass filter 54. Low-pass filter 54 suppresses the signal harmonics or overtones relative to the fundamental. The filter removes signal harmonics over a one-octave range in order to prevent overtones from actuating motor 288 and detuning the kettledrum inadvertently. The ratio between a given fundamental and its overtone is held constant over the one octave range by low-pass filter 54. The filtered signal is then fed through resistor 78 to operational amplifier 80. Operational amplifier 80 is part of compression amplifier 18.

Compression amplifier 18 functions as an automatic gain control or automatic level control. A signal which is amplified by amplifier 80 is fed to detector 76. Detector 76 includes a transistor 100. Collector 106 of transistor 110 is biased at a fixed voltage through the action of potentiometer 110, which is part of the voltage divider network comprised of resistors 108, 110 and 112. An increase in the output of amplifier 80 will cause transistor 100 to draw more current. When transistor 100 draws more current, the voltage at gate 120 of Field Effect Transistor 118 decreases. The reduction in gate voltage at gate 120 reduces the channel resistance of Field Effect Transistor 118, thereby attenuating the input signal and reducing the output of amplifier 80. In this particular circuit, the control signal received from transistor 100 and line 107 is an inverted control signal.

The inverted control signal is also received at first level detector 428 and second level detector 430. In this circuit, logic 1 is equivalent to a positive voltage. Logic 0 is equivalent to a more negative voltage. The control signal is received at the inverting terminal 436 of operation amplifier 432, and at non-inverting terminal 462 of operational amplifier 458. Operational amplifiers 432 and 458 function, in this case, as differential amplifiers. Operational amplifier 432 is biased at its non-inverting terminal 434 by an output reference signal of potentiometer 440. Operational amplifier 458 is biased at its inverting terminal 460 by an output reference signal of potentiometer 450. When the control signal is between the reference signal levels, operational amplifiers 432 and 458 will both produce positive voltages. If the control signal swings outside of either reference signal level, one or the other of operational amplifiers 432 and 458 will no longer produce a positive signal. Operational amplifiers 432 and 458 feed their output signals to AND gate 414.

AND gate 414 produces a logic 1 at its output terminal 416 only when a positive voltage or logic 1 is present at both input gates 418 and 420. Thus, AND gate 414 only produces a logic 1 signal when the control signal is between the two reference levels, as set by potentiometer 440 and potentiometer 450.

The output signal from operational amplifier 80 is also fed to square wave generator 128 via capacitor 130 and resistor 132. Operational amplifier 134 and associated resistances 132 and 136, and ground resistance 138, together with capacitor 130, function to amplify the essentially sinusoidal signal received from operational amplifier 80. The amplifier sinusoidal signal is also clipped by circuit 128 to produce a square wave, having the same period as the sinusoidal signal received from operational amplifier 80. The square wave is then fed to a divide circuit 140.

Divide circuit 140, in the present embodiment, divides the signal period by two, that is, divide circuit 140 produces a square wave having the same amplitude as the square wave received from operational amplifier 134, but having a period twice as long. Divide circuit 140 functions as a divide-by-two-circuit. The square wave produced by divide circuit 140 is then fed through resistor 142 to input terminal 148 of exclusive OR gate 146. Resistor 142 and capacitor 144 function as an integrating circuit. Exclusive OR gate 146 produces a logic 1, or positive output, if terminal 148 is logic 1 and terminal 150 is logic 0; or if terminal 148 is logic 0 and terminal 150 is logic 1. Across the tops and bottoms of the square wave, both terminals 148 and 150 will be at the same potential. Therefore, exclusive OR gate output will be held at 0; and exclusive OR gate 146 will only produce a logic 1 in the form of a pulse responsive to the leading and trailing sides of the square wave which it receives. Exclusive OR gate 146 produces a latch pulse; and the latch pulse is timed to occur at each signal cycle received by divide circuit 140.

Likewise, exclusive OR gate 170 functions in a similar fashion to produce a reset pulse. However, it should be noted that a resistance 166 and a capacitor 168 are connected to input terminal 174. The resistor 166 and capacitor 168 provide integrating action. The value of resistances 142, 162 and 166 is 100 ohms in the present embodiment. The value of capacitances 144, 164 and 168 is, respectively, 0.001 microfarad, 0.0022 microfarad and 0.0033 microfarad. It is apparent that the time constants of resistance-capacitance pair 142 and 144, resistance-capacitance pair 162 and 164, and resistor 166 and capacitor 168, are different. Since the time constants of the RC circuits connected to input terminals 172 and 174, respectively are different and gate 170 is an exlusive OR gate, a reset pulse will be produced on the order of one micorsecond after the latch pulse.

The latch pulse is also fed through a grounded integrating circuit formed by resistor 210 and capacitor 212. The latch pulse is then received by input terminal 216 of NOR gate 214. NOR gate 124 provides logic 1 output when input terminals 216 and 218 are both logic 0. When input terminals 216 and 218 are in states of logic 0-logic 1, or logic 1-logic 0, or logic 1-logic 1, then a logic 0 is produced at output terminal 200. Thus, in order to supply a clock pulse to twelve-stage binary counter 20 at clock terminal 180, it is necessary that both terminals 216 and 218 be at logic 0. Terminal 218 is connected to clock 22, as seen above. Therefore, the latch pulse cuts off clock 22. Thus, when the latch pulse is produced, clock 22 is cut off. A short time later, latches 250, 252 and 254 lock in the counter from counter 20; and then counter 20 receives the reset pulse. It may also be appreciated that divide circuit 140, in other embodiments, can divide the signal by four, six, eight, or higher even integers, to provide an averaging effect over several signal periods.

Clock 22 employs a pair of ganged NOR gates, both of which produce logic 1 at their respective outputs 228 and 246 when their inputs 224 and 226, or 242 and 244, are both at 0. Terminals 226 and 244 are held at 0 by connecting them to ground. Terminal 224 is alternately pulsed 0 and 1 through the action of quartz crystal 234, and capacitors 236 and 238, and resistors 230 and 232.

When input terminal 224 is 0, output terminal 228 of NOR gate 222 is logic 1. When input terminal 224 is logic 1, output terminal 228 is logic 0, thus forcing NOR gate 240 to produce a logic 1 at its output. When logic 1 is produced at output terminal 246, it produces a logic 1 at input terminal 218 of NOR gate 214. Thus, a 0 pulse at input terminal 224 produces a 0 pulse at input terminal 218. A 1 pulse at input terminal 224 produces a 1 pulse at input terminal 218. In order to provide a logic 1 to clock terminal 180 of twelve-stage binary counter 20, it is necessary that input terminal 224 be pulsed to logic 1.

Clock 22, as stated above, is controlled and timed by quartz crystal 234. Clock 22, in the present embodiment, is constructed to produce a 440-kilohertz stable cock signal. Thus, clock terminal 180 of twelve-stage binary counter 20 receives a 440-kilohertz clock signal. In the present embodiment, quartz crystals having various natural frequencies can be substituted for quartz crystals 234. Thereby allowing quick and easy changing of the clock frequency. This clock signal is counted by binary counter 20. Binary counter 20 also operates under positive logic 1. Thus, when a positive reset pulse is received from exclusive OR gate 174 through lead 178 at reset terminal 182, twelve-stage binary counter 20 resets. Thus, in between each reset pulse, twelve-stage binary counter 20 counts the number of pulses received at its clock terminal 180.

Twelve-stage binary counter 20 is a twelve-bit binary counter. Twelve-stage binary counter 20 is capable of counting any decimal number between 0 and 4095, and outputting the result in binary numbers at terminals 184 through 206. A twelve-bit counter was employed in the present embodiment in order to yield 0.1% accuracy. However, other counters could also be employed.

Latches 250, 252 and 254 are connected, as described above, to the output terminals 184 through 206 of twelve-stage binary counter 20. When the latch pulse is generated by exclusive OR gate 146, it is received at enable terminals 264, 274 and 284 of latches 250, 252 and 254, respectively, thereby storing the current twelve-bit binary number as three four-bit numbers in latches 250, 252 and 254, respectively. Latch 250 stores the low order four-bits; latch 252, the next higher order ; and latch 254, the highest order four-bits.

The four-bit numbers, which are stored in the latches, correspond to the four-bit numbers generated as part of the twelve-bit number by binary counter 20 at the time that the latch pulse occurs. Thus, the four-bit number at terminals 184, 186, 188 and 190 will be latched and stored, to be read at terminals 286, 288, 290 and 292 of latch 250. The next four-bit number received from terminals 192, 194, 196 and 198 will be latched and stored for reading at latch terminals 294, 296, 298 and 300. The highest order four-bit number, which is displayed at counter terminals 200, 202, 204 and 206, will be stored and readable at terminals 302, 304, 306 and 308 of latch 254.

The lowest order bit stored by latches 250, 252 and 254 is displayed at latch output terminal 286. The next higher order bits, in their ascending value, are displayed, respectively, at terminals 288, 290, 292; 294, 296 298, 300; and 302, 304, 306, 308. Comparator 310 receives the lowest order four-bits at its input terminals 316, 318, 320 and 322. Comparator 312 receives the next higher order four-bits at its input terminals 346, 348, 350 and 352, respectively. Comparator 314 receives the highest order four-bits at terminals 376, 378, 380 and 382, respectively.

In use, the period of the frequency that is to be selected to be tuned for the drum head is selected by switching a single switch on or off out of a multiplicity of swiches. For instance, in the present embodiment, three switches 536, 538 and 540 are connected to rows 530, 532 and 534, respectively, at matrix 26. When switch 536 is switched on, in the present embodiment, binary number 000001011111 is produced at terminals 506 through 528, respectively. This binary number is fed into terminals 324, 326, 328 and 330 of comparator 310; terminals 354, 356, 358 and 360 of comparator 312; and terminals 384, 386, 388 and 390 of comparator 314. It may be appreciated that, since twelve-stage binary counter 20 and latches 250 through 254 count and store binary numbers in inverted order, it is necessary to code the period of the frequency in inverted order. This is conventional in the art. Therefore, the actual binary number which is being encoded when switch 536 is closed is number 111110100000, or 4,000 in decimal notation. In the present embodiment, an encoding of 4,000, with a clock frequency of 440 kilohertz, corresponds to the period of a drumhead fundamental frequency of 110 hertz. This is equivalent to the key of A. Thus, by switching on switch 536, the key of A is encoded in binary notation. Likewise, when switch 538 is closed, the key of A sharp, having a fundamental frequency of 116.540 hertz, a decimal clock count of 3,776 or a binary count of 111011000000, is encoded by encoding matrix 26. In a similar fashion, the key of D, having a drum fundamental frequency of 123.470 hertz and a clock count of 3,564, to which corresponds the binary interchange code 110111101100, is encoded by matrix 26. Thus, by closing one of swiches 536, 538 or 540, a binary number corresponding to a desired period of a drum fundamental tone is generated. The above-mentioned encoding is for the tempered scale. It may be appreciated that other scales and frequencies may also be encoded.

Furthermore, it may be appreciated that, by adding more rows and diodes to input encoder 26, any number of notes or frequencies may be encoded. The diode matrix 26 of the present embodiment has been chosen for ease and economy of construction. However, other encoding systems can be employed.

Terminal 332 of comparator 310 is an input terminal which receives a logic 1 input when the counter number is higher than the matrix number. Terminal 336 is an input terminal which is to receive a logic 1 when the counter number is smaller than the input encoded number. Both of these terminals are held to ground, which sets them at logic 0. Terminal 334 is the equality input terminal, that is, terminal 334 is designed to received a logic 1 or a positive voltage signal if the counter number is presumed to be equal to the encoded number. Terminals 332, 334 and 336 are input terminals which are used when ganging comparators together. Since comparator 310 is not ganged with any other comparator, it is necessary to ground terminals 332 and 336, and artificially force terminal 334 to logic 1. In a similar fashion, terminals 340, 342 and 344 are output terminals. A logic 1 will be generated at terminal 340 if the number received at counter input terminals 316 through 322 is larger than the number received at encoder input terminals 324 through 330. Terminal 342 generates a logic 1 if both the counter number and the encoder number are equal. Terminal 344 generates a logic 1 if the counter number is smaller than the encoder number.

Latch 312 similarly has its input terminal 362, which is the terminal for inputting logic 1 if the counter number is greater than the encoder number, and input terminal 366, which is the terminal for inputting a logic 1 if the encoder number is larger than the counter number. Both of these terminals are held to ground. Similarly, terminal 364, which corresponds to the terminal which receives a logic 1 input if the counter number is equal to the encoder number, is held at logic 1. Terminals 370, 372 and 374 are output terminals for comparator 312. Terminal 370 generates a logic 1 if the counter number is greater than the encoder number. Terminal 372 generates a logic 1 if the counter number is equal to the encoder number. Terminal 374 generates a logic 1 if the counter number is less than the encoder number. It will be noted that comparators 312 and 314 are ganged. Therefore, a logic 1 will be shifted into the input terminals 392, 394 and 396, which produce logic 1's when, respectively, a counter number is greater than the encoder number, a counter number is equal to the encoder number, or a counter number is less than the encoder number. Terminals 398, 400 and 402 are output terminals for comparator 314. Terminal 398 generates a logic 1 if the counter number is greater than the encoder number. Terminal 400 generates a logic 1 if the counter number is equal to the encoder number; and terminal 402 generates a logic 1 if the counter number is less than the encoder number.

Thus, when, in the four least significant digits, the counter number, or the digital count the clock, is greater than the encoded input, a logic 1 is produced at terminal 340.

When the encoder number is greater than the counter number, terminal 344 produces a logic 1. In the eight most significant digits, when the counter number is greater than the encoded number, terminal 398 produces a logic 1. When the counter number equals the encoder number in the eight most significant digits of the binary number encoded, output terminal 400 produces a logic 1. When, in the eight most significant digits, the counter number is less than the encoder number, terminal 402 of comparator 314 produces a logic 1.

It should be remembered that the counter number corresponds to the number of clock pulses generated for each signal cycle. Thus, the counter number and the encoder number are inversely related to the actual frequency and desired frequency of the drumhead, respectively. Therefore, if the counter number is larger than the encoder number, the fundamental frequency of the drumhead is below that desired by the operator of the drum. In a like manner, if the counter number is less than the encoder number, the fundamental frequency to which the drumhead is then tuned is greater than the desired drum fundamental frequency.

When the counter number is greater than the encoder number in the four least significant bits, terminal 340 generates a logic 1, which is transmitted to input terminal 482 of NAND gate 480. When the counter number is less than the encoder number in the four least significant digits, terminal 344 of comparator 310 generates a logic 1, which is, in turn, inputted to input terminal 406 of NAND gate 404. In a similar fashion, if the counter number is greater than the encoder number for the most significant digits, terminal 398 of comparator 314 generates a logic 1, which is transmitted to NAND gate 498 at terminal 500. When the counter number is equal to the encoder number, logic 1 is generated at terminal 400 of comparator 314. A logic 1 is also generated at input terminal 408 of NAND gate 404 and input terminal 484 of NAND gate 480. When the eight most significant digits of the encoder number are smaller than the eight most significant digits of the counter number, a logic 1 is generated at termical 402 of comparator 314. The logic 1 is transmitted to input terminal 492 of NAND gate 490.

When logic 1 is present at all input terminals of the NAND gates 404, 480, 490 or 498, the NAND gates produce an output having logic 0. When any other combination of inputs, either all logic 0, or some logic 0-logic 1, is supplied to NAND gates 404, 480, 490 and 498, a logic 1 or positive voltage is produced, respectively, at output terminals 412, 488, 496 and 504. In order for NAND gates 404, 480, 490 and 498 to produce a logic 0 output, it is necessary that each of their respective input terminals be biased to logic 1 or a positive voltage. Input terminals 410 of gate 404, 486 of gate 480, 494 of gate 490, and 502 of gate 498, are connected in parallel to lead 411. Lead 411 is connected to AND gate 414. As was stated above, AND gate 414 only produces logic 1 when the control signal is between a pair of preselected levels. Thus, gates 404, 480, 490 and 498 can only produce a logic 0 response when the control signal is between the pair of reference levels. AND gate 414, together with level detectors 428 and 430, acts as a tuning enable circuit, which prevents gate 404, 480, 490 and 498 from producing a logic 0 response when the control signal is outside of the reference limits. The triggering levels for gate 414 are directly controlled by variable resistors 440 and 450, which control differential inputs 434 and 460 of operationals amplifiers 432 and 458, respectively. Thus, the signal received by the tone sensor cannot be of very large amplitude or very small amplitude if it is to be processed. A large amplitude tone contains a proportionally larger percentage of harmonics.

Since low-pass filter 54 cannot remove all harmonics, in order to have proper filtering and processing, it is necessary to allow the signal to decay before it can activate motor 28. Therefore, level detector 428 prevents motor 28 from being activated by a large amplitude signal with a high percentage of harmonics. It is also necessary that motor 28 not be actuated by low-level extraneous vibrations of drumhead 12 or by electronic noise in musical instrument tuner 10. The extraneous vibrations are often caused by sympathetic vibration of drumhead 12 in response to outside noise.

When logic 1 is generated on lead 411, transistor 466 is biased ON, thereby allowing current to flow through resistor 476, light-emitting diode 474, collector 470 and emitter 472, and thereby lighting light-emitting diode 474. Light-emitting diode 474 is lit when the tuning is active, or enabled, and when the control signal is between the pair of reference levels.

NAND gates 404 and 480 can be termed proportional-up and proportional-down gates, respectively. NAND gates 490 and 498 can be termed full-up and full-down gates, respectively. The reason for using this particular terminoloygy will become apparent below.

FETS 728, 738, 746 and 758 are all P-channel depletion mode FETS. Therefore, FETS 728, 738, 746 and 758 are in the ON condition when 0 voltage is applied to their respective gates 730, 740, 748 and 760. As was stated above, 0 voltage in this case corresponds to logic 0 in this circuit. Therefore, when logic 0 is outputted by NAND gates 404, 480, 490 or 498, respectively, FETS 728, 738, 746 or 758 are respectively switched ON. If NAND gates 404, 480, 490 or 498 produce a logic 1, corresponding FETS 728, 738, 746 or 758 are likewise switched OFF.

Input terminals 612, 618, 624 and 630 receive, respectively, the lowest order four digits of the couner number. In a similar fashion, input terminals 614, 620, 626 and 632 receive the lowest order four digits of the binary encoder number. Gates 604, 606, 608 and 610 are exclusive OR gates. Therefore, they produce logic 1 at their output terminals 616, 622, 628 and 634, respectively, if the logic levels at their respective input terminals are unequal. Thus, exclusive OR gates 604, 606, 608 and 610 will produce logic 0 at their outputs 616, 622, 628 and 634, respective 16, if the lowest order four digits of the counter number are equal to the lowest order four digits of the encoder number.

In this particular embodiment, resistors 650, 648, 646 and 644 have the respective value of 80 kilohms, 40 kilohms, 20 kilohms and 10 kilohms. Transistors 660, 672, 680 and 688 are held ON by the positive potential at lead 670, impressed on bases 662, 674, 682 and 690, respectively. Therefore, when a signal is present at emitters 664, 676, 684 or 692, the signal is conducted to lead 668. It is apparent that the signal strengths produced at diodes 636, 638, 640 and 642 bear the proportions of 1:2:4:8. Thus, when a logic 0 is produced at outputs 616, 622, 628 or 634, respectively, the signal at resistors 644, 646, 648 or 650, respectively, is conducted away from emitters 664, 676, 684 and 692, respectively. In a similar fashion, when the inputs are unequal, and thereby produce a logic 1 at output terminals 616, 622, 628 and 634, diodes 636, 638, 640 or 642, respectively, will be blocked, thereby channelling the signal through transistors 660, 672, 684 and 688, respectively, to lead 668. Thus, an analog signal proportional to the difference between the lowest order four digits of the counter number and the lowest order four digits of the encoder number is produced at line 668.

This difference signal is received at non-inverting terminal 700 of operational amplifier 698, and at inverting terminal 716 of operational amplifier 712. The difference signal is amplified an equal amount by both operational amplifiers 698 and 712. The signal is amplified normally by operational amplifier 698. The signal is inverted by operatonal amplifier 712. Thus, an inverted amplified difference signal is supplied to source 732 of FET 728; and a non-inverted amplified difference signal is supplied to source 742 of FET 738. An up voltage is supplied to point 756; and then to source 750 of FET 746 through dropping resistor 754. A down voltage is supplied to point 768; and dropped through resistor 766 to source 762 of FET 758.

When FET 728 is switched ON in response to a logic 0 signal from lead 412 and NAND gate 404, the inverted analog difference signal is channelled to lead 736 through drain 742 of FET 728.

When NAND gate 480 outputs logic 0 at output terminal 488, FET 738 is switched ON, thereby channelling the non-inverted analog difference signal from source terminal 742 through drain terminal 744 to lead 736.

When NAND gate 490 generates logic 0 at output terminal 496, FET 746 is switched ON; and conducts the voltage signal for full-up through source 750 to drain 752 and lead 736.

When NAND gate 498 generates logic 0 at output lead 504, FET 758 switches ON; and thereby conducts the full-down potential through source 762 to drain 764 and, hence, to lead 736. Thus, one of the inverted analog difference signal, the noninverted analog difference signal, the full-up signal, or the full-down signal, is switched, via FET'S 728, 738, 746 or 758, respectively, to lead 736. The signal supplied to lead 736 is thereby transmitted to inverting input terminal 770 of operational amplifier 767. Non-inverting input termial 769 of operational amplifier 767 is effectively tied to ground. Thus, the signal, which is actually an error signal, is amplified by operational amplifier 767. Meter 780 receives the output of operational amplifer 767, which is the amplified error signal; and gives a visual indication of the magnitude of the error signal.

The amplified error signal is received at inverting terminal 786 of operational amplifier 784. The signal is outputted and inverted by operational amplifier 794 at output terminal 790. The output signal is then supplied to bases 796 and 814 of transistors 794 and 812, respectively. Transistor 794 is biased by a positive motor control voltage at collector 800. Transistor 812 is biased by a negative motor control voltage at collector 818. A motor control signal is then generated by either transistor 794 or 812 in response to the output signal supplied to bases 794 and 814. The motor control signal is thereby supplied to either base 806 of transistor 804 or base 824 of transistor 822. The motor control signal is further amplified; and is supplied to lead 830. Lead 830 then supplies the amplified motor control signal to motor 28. Tachometer 832, which is connected to motor 28, supplies a tachometer signal to lead 834. Therefore, a full-speed signal is supplied to motor 28 when the highest order eight bits are unequal; and a variable slow-speed analog signal is supplied to motor 28 when only the lowest order four bits are unequal. The tachometer signal is supplied by lead 834 to non-inverting terminal 788 of operational amplifier 784. The tachometer signal acts as a negative feedback signal to prevent overrun of motor 28.

When motor 28 runs in response to the amplified error signal, gear 848 turns gear 849. Gear 849 thereby draws threaded rod 850 down into base 840, or forces threaded rod 850 up out of base 840. The terms full-up, full-down, proportional-up, and proportional-down, indicate the velocity of travel of threaded rod 850.

Threaded rod 850 draws on the tension lines to pull counter hoop 892 down or allow it to rise. When counter hoop 892 is pulled down, the tension is increased on drumhead 12, thereby shortening the period of the drum fundamental. In a similar fashion, when counter hoop 892 rises, the tension on drumhead 12 is reduced, thereby lowering the drumhead fundamental frequency or lengthening its period.

Thus, a signal is generated by vibration sensor 16 in response to the movement of drumhead 12. Harmonics are removed from the signal by low-pass filter 54. Compression amplifier 18 maintains the signal at a constant level. The signal is converted to a square wave by square generator 128. Counter 20, connected to clock 22 and square wave generator 128, determines the period of the drumhead signal. The period of the drumhead signal is compared in comparators 310, 312 and 314 to a desired period encoded by diode matrix 26. Level detectors 428 and 430 prevent further signal processing unless the signal is within a selected amplitude range. Any difference between the actual and desired periods is outputted by the comparator as an error signal which drives motor 28. Motor 28 drives linkage 14 to alter the tension of drumhead 12 to reduce the difference between the selected period and the actual period.

It may be appreciated that the present inventon is easy to operate, even in darkened areas such as an orchestra pit, since only a single switch need be closed to tune the fundamental frequency of the musical instrument.

It may also be appreciated that the use of optical vibration sensor 16 prevents extraneous sounds from influencing the circuit. If a conventional audio pick-up had been used, the extraneous sounds would have improperly actuated the circuit.

It may also be appreciated that the use of the level detectors aids in harmonic suppression since harmonics have been found to decay faster than their fundamental.

It may be further appreciated that the present circuit is very accurate since it determines the period of the input signal for each comlete cycle.

Although a specific embodiment of the herein-disclosed musical instrument tuning device, adapted for use with a drum, has been described in detail above, it is readily apparent that those skilled in the art may use the present invention to tune precussion and string instruments; and may make various modifications and changes in the present invention without departing from the spirit and scope of the present invention. Therefore, the present invention is limited only by the appended claims.

What is claimed is:

1. A drum tuning device for adjusting the tension on a drumhead comprising: a vibration sensor producing a sensor signal responsive to movement of said drumhead; a low-pass harmonic filter, connected to said vibration sensor to receive said sensor signal, said low-pass harmonic filter being adapted to pass a fundamental signal of said sensor signal; a compression amplifier connected to said low-pass harmonic filter, said compression amplifier being adapted to receive said fundamental signal and normalize said fundamental signal; a square wave amplifier-shaper connected to said compression amplifier to receive said normalized fundamental signal, said wave amplifier-shaper being adapted to convert said normalized filtered signal to a square wave signal; a pulse delay circuit, connected to said square wave amplifier-shaper to receive said square wave signal, said pulse delay circuit producing a reset pulse and a latch pulse timed with a portion of said square wave signal; a crystal controlled clock producing a plurality of clock pulses; a digital counter connected to said crystal controlled clock to receive said clock pulses, said digital counter being connected to said pulse delay circuit to receive said reset pulse, said digital counter being adapted to count said clock pulses and generate a counter signal, said digital counter being adapted periodically to be reset upon receiving said reset pulse; a plurality of latches connected to said digital counter, said plurality of latches being connected to said pulse delay circuit, said plurality of latches being adapted to receive said counter signal, said plurality of latches being adapted to store said counter signal upon receipt of said latch pulse from said pulse delay circuit, said plurality of latches producing a stored count signal; a diode matrix binary encoder producing a digital signal indicative of a frequency to be selected for tuning the drum; a first plurality of comparators, each comparator of said first plurality being connected to a latch, each comparator of said first plurality being connected to said diode matrix binary encoder, each comparator of said first plurality receiving a portion of said stored count signal from said latches, each comparator of said plurality receiving a portion of said digital signal from said diode matrix binary encoder; said first plurality of comparators producing a difference signal indicative of the difference between the stored count signal and the digital signal from said diode matrix binary encoder; a second comparator and digital-to-analog converter connected to said first plurality of comparators, said digital-to-analog converter producing an analog difference signal indicative of the difference between a plurality of low-order bits of said stored count signal and said digital signal from said diode matrix binary encoder; a level detector connected to said compression amplifier, said level detector also being connected to said first plurality of comparators, said level detector receiving a portion of said filtered signal from said low-pass harmonic filter, said level detector producing a level detector signal indicative of an amplitude of said filtered signal; a motor drive amplifier connected to said first plurality of comparators and said second comparator and digital-to-analog converter, said motor drive amplifier being responsive to said difference signal and said analog difference signal, said motor drive amplifier producing an amplified signal; and an electric motor-tachometer connected to said motor drive amplifier,said electric motor-tachometer being drivingly connected to said drumhead of said drum, said electric motor-tachometer being responsive to said level detector signal, said electric motor-tachometer being responsive to said amplifier signal, said electric motor-tachometer being adapted to adjust the tension of said drumhead to minimize said amplifier signal.

2. A drum tuning device as defined in claim 1, in which said vibration sensor is an optical sensor.

3. A drum tuning device as defined in claim 1, in which said filter is a low-pass harmonic filter having four stages.

4. A drum tuning device as defined in claim 1, in which said crystal controlled clock includes a pair of ganged NOR gates.

5. A drum tuning device as defined in claim 1, in which each of said level detection circuits includes an operational amplifier.

6. A drum tuning device as defined in claim 1, in which said digital counter is a twelve-bit binary counter.

7. A drum tuning device as defined in claim 1, in which said motor drive amplifier employs a first pair of transistors and a second pair of transistors, said first and second transistors pairs being connected oppositely and symmetrically.

8. A drum tuning device as defined in claim 1, in which said motor-tachometer combination includes a reversing, automatically locking electric motor.

* * * * *

UNITED STATES PATENT OFFICE

CERTIFICATE OF CORRECTION

PATENT NO. : 4,023,462

DATED : May 17, 1977

INVENTOR(S) : Sam Denov; Rame W. Bull; and Walter Scott Bartky

It is certified that error appears in the above-identified patent and that said Letters Patent are hereby corrected as shown below:

Column 1, Line 21, "returned" should be --retuned-.

Column 1, Line 26, "kettledurms" should be --kettledrums--.

Column 5, Line 20, "inludes" should be --includes--.

Column 7, Line 30, "potentiomenter" should be --potentiometer--.

Column 7, Line 43, "Noninverting" should be --Non-inverting--.

Column 8, Line 10, after "has", insert --a--.

Column 8, Line 12, after "540", insert --,--.

Column 8, Line 34, "termnals" should be --terminals--.

Column 8, Line 41, after "gate", insert --604--.

Column 8, Line 57, "doide" should be --diode--.

Column 9, Line 14, "Colllector" should be "Collector--.

UNITED STATES PATENT OFFICE

CERTIFICATE OF CORRECTION

PATENT NO. : 4,023,462

DATED : May 17, 1977

INVENTOR(S) : Sam Denov; Rame W. Bull; and Walter Scott Bartky

It is certified that error appears in the above-identified patent and that said Letters Patent are hereby corrected as shown below:

Column 10, Line 5, "noninverting" should be --non-inverting--.

Column 10, Line 60, after "linkage", insert --14--.

Column 11, Line 3, "hingledly" should be --hingedly--.

Column 11, Line 38, "288" should be --28--.

Column 12, Line 66, "exlusive" should be --exclusive--.

Column 12, Line 67, "micorsecond" should be --microsecond--.

Column 13, Line 4, "124" should be --214--.

Column 13, Line 15, "counter" should be --count--.

Column 13, Line 44, "cock" should be --clock--.

Column 13, Line 48, "crystals" should be --crystal--.

Column 13, Line 48, ". Thereby" should be --, thereby--.

UNITED STATES PATENT OFFICE

CERTIFICATE OF CORRECTION

PATENT NO. : 4,023,462

DATED : May 17, 1977

INVENTOR(S) : Sam Denov; Rame W. Bull; and Walter Scott Bartky

It is certified that error appears in the above-identified patent and that said Letters Patent are hereby corrected as shown below:

Column 14, Line 24, after "296", insert --,--.

Column 14, Line 32, "drum head" should be --drumhead--.

Column 14, Line 34, "swiches" should be --switches--.

Column 14, Line 64, "swiches" should be --switches--.

Column 15, Line 14, "received" should be --receive--.

Column 15, Line 60, after "count", insert --from--.

Column 16, Line 36, "termical" should be --terminal--.

Column 16, Line 59, "gate" should be --gates--.

Column 16, Line 64, "operationals" should be --operational--

Column 17, Line 24, "terminoloygy" should be --terminology--

UNITED STATES PATENT OFFICE

CERTIFICATE OF CORRECTION

PATENT NO. : 4,023,462

DATED : May 17, 1977

INVENTOR(S) : Sam Denov; Rame W. Bull; and Walter Scott Bartky

It is certified that error appears in the above-identified patent and that said Letters Patent are hereby corrected as shown below:

Column 18, Line 9, "operatonal" should be --operational--.

Column 18, Line 34, "noninverted" should be --non-inverted--.

Column 18, Line 39, "termial" should be --terminal--.

Column 19, Line 51, "comlete" should be --complete--.

Column 20, Line 7, after "said", insert --square--.

Signed and Sealed this

*Twenty-ninth* Day of *November 197*

[SEAL]

*Attest:*

RUTH C. MASON
*Attesting Officer*

LUTRELLE F. PARKER
*Acting Commissioner of Patents and Trademark*